US006694691B2

(12) United States Patent
Ku

(10) Patent No.: US 6,694,691 B2
(45) Date of Patent: Feb. 24, 2004

(54) COMBINATION FLOOR PAD HAVING COMPOSITE BASE BOARDS

(76) Inventor: Chen Chung Ku, No. 52, Lane 213, Yungkang Rd., Fengyuan City, Taichung 420 (TW)

( * ) Notice: Subject to any disclaimer, the term of this patent is extended or adjusted under 35 U.S.C. 154(b) by 0 days.

(21) Appl. No.: 10/391,077

(22) Filed: Mar. 17, 2003

(65) Prior Publication Data

US 2003/0177728 A1 Sep. 25, 2003

Related U.S. Application Data

(63) Continuation-in-part of application No. 10/051,129, filed on Jan. 22, 2002, now abandoned.

(51) Int. Cl.[7] ..... E04F 15/22
(52) U.S. Cl. ..... 52/403.1; 52/480
(58) Field of Search ..... 52/403.1, 177, 52/181, 392, 314, 592.1, 318, 408, 414, 449, 450, 588.1

(56) References Cited

U.S. PATENT DOCUMENTS

| | | | | |
|---|---|---|---|---|
| 3,387,422 A | | 6/1968 | Wanzer | 52/387 |
| 4,226,064 A | | 10/1980 | Kraayenhof | 52/180 |
| 5,323,575 A | | 6/1994 | Yeh | 52/177 |
| 5,806,270 A | | 9/1998 | Solano et al. | 52/747.11 |
| 6,098,362 A | | 8/2000 | Marriott et al. | 52/302.3 |
| 6,363,677 B1 | | 4/2002 | Chen et al. | 52/586.1 |
| 6,418,691 B1 | | 7/2002 | Stroppiana | 52/480 |
| 6,453,632 B1 | | 9/2002 | Huang | 52/403.1 |
| 6,490,838 B2 | | 12/2002 | Summerford | 52/650 |
| 6,550,206 B2 | * | 4/2003 | Lee | 52/480 |
| 6,619,000 B1 | * | 9/2003 | Chiu-Ying | 52/127.3 |

OTHER PUBLICATIONS

Patent application Publication US 2003/0093964 A1 to Bushey et al; Publication Date May 22, 2003.*

* cited by examiner

*Primary Examiner*—Ramon O. Ramirez
(74) *Attorney, Agent, or Firm*—Alan D. Kamrath; Rider Bennett, LLP

(57) ABSTRACT

A combination floor pad includes at least one base pad, and a plurality of composite base boards fixed on the base pad. Thus, the base boards can be securely locked in the base pad rigidly and stably, thereby preventing the base boards from being detached or loosened from the base pad. In addition, the base boards can be closely secured by the side ribs and the positioning ribs, so that dirt or dust is not deposited between the base boards easily, thereby facilitating the user cleaning the base boards.

9 Claims, 4 Drawing Sheets

COMBINATION FLOOR PAD HAVING COMPOSITE BASE BOARDS

CROSS-REFERENCES TO RELATED APPLICATIONS

The present invention is a continuation-in-part application of the U.S. Ser. No. 10/051,129, filed on Jan. 22, 2002, now abandoned.

BACKGROUND OF THE INVENTION

1. Field of the Invention

The present invention relates to a combination floor pad having composite base boards, and more particularly to a combination floor pad that can be used in the bathroom, the yard or the like.

2. Description of the Related Art

A conventional floor pad used in the bathroom in accordance with the prior art is disclosed in the Taiwanese Patent Publication No. 439817, comprising multiple plastic base boards integrally formed with each other, and multiple wooden tread boards mounted on the base boards.

However, the conventional floor pad in accordance with the prior art has the following disadvantages.

1. The tread boards are easily detached from the base boards, thereby causing inconvenience to the user.
2. The tread boards have gaps formed therebetween, so that dirt, dust or the like are easily deposited in the gaps between the tread boards, thereby incurring the sanitary problem, and thereby causing inconvenience in cleaning the dirt.
3. The tiny article easily falls into the gaps between the tread boards, so that the tiny articles are easily lost.

SUMMARY OF THE INVENTION

The primary objective of the present invention is to provide a combination floor pad having composite base boards, wherein the base boards can be securely locked in the base pad rigidly and stably, thereby preventing the base boards from being detached or loosened from the base pad.

Another objective of the present invention is to provide a combination floor pad having composite base boards, wherein the base boards can be closely secured by the side ribs and the positioning ribs, so that dirt or dust is not deposited between the base boards easily, thereby facilitating the user cleaning the base boards.

In accordance with the present invention, there is provided a combination floor pad having composite base boards, comprising at least one base pad, and a plurality of base boards fixed on the base pad, wherein:

each of the base boards has four sides each formed with an arcuate groove;

the base pad has four sides, wherein two adjacent sides of the base pad are formed with a plurality of recessed locking portions, and the other two adjacent sides of the base pad are formed with a plurality of snapping portions;

the base pad has a periphery formed with four flexible side ribs so as to seal and encompass the periphery of the base pad;

the base pad has a surface formed with a plurality of flexible positioning ribs which are arranged longitudinally and transversely in a staggered manner, the positioning ribs are connected with each other and are connected with the four side ribs, thereby forming multiple receiving spaces in the base pad for insertion of the base boards;

each of the four side ribs has an inner side formed with a plurality of arcuate protruding portions that can be inserted into the respective arcuate groove of the base board when the base board is inserted into the respective receiving space of the base pad; and each of the positioning ribs has two sides each formed with an arcuate protruding portion that can be inserted into the respective arcuate groove of the base board when the base board is inserted into the receiving space of the base pad.

Further benefits and advantages of the present invention will become apparent after a careful reading of the detailed description with appropriate reference to the accompanying drawings.

DETAILED DESCRIPTION OF THE INVENTION

Figure 1:
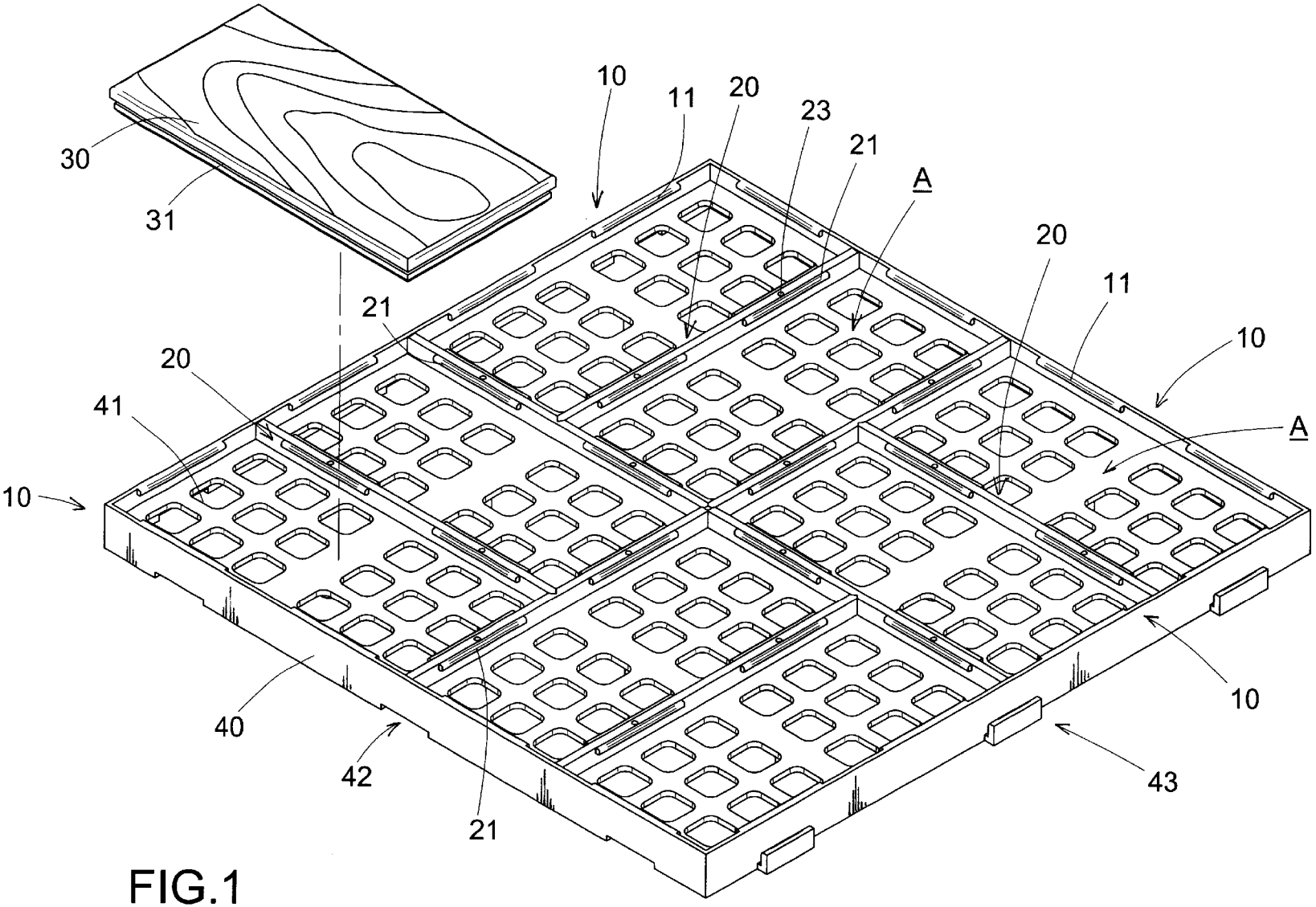
FIG. 1 is an exploded perspective view of a combination floor pad having composite base boards in accordance with the preferred embodiment of the present invention.
Figure 2:
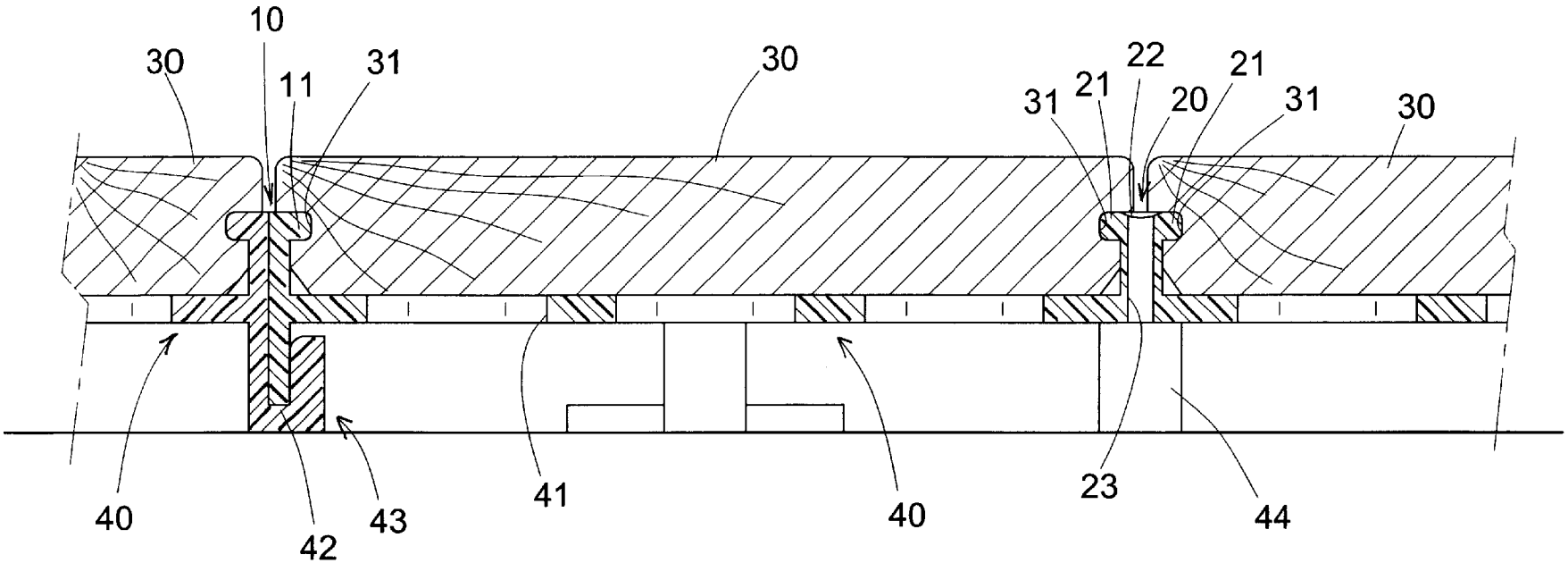
FIG. 2 is a partially cut-away plan cross-sectional assembly view of the combination floor pad having composite base boards in accordance with the preferred embodiment of the present invention.

Referring to the drawings and initially to FIGS. 1 and 2, a combination floor pad in accordance with the preferred embodiment of the present invention comprises at least one base pad 40, and a plurality of base boards 30 fixed on the base pad 40.

Each of the base boards 30 is a rectangular plate made of wood material or stone material. Each of the base boards 30 has four sides each formed with an arcuate groove 31 extended along the longitudinal direction thereof.

The base pad 40 is made of plastic material so that the base pad 40 is flexible and resilient. The base pad 40 is formed with a plurality of through holes 41. The base pad 40 has a bottom provided with a plurality of reinforcing posts 44 as shown in FIG. 2 to strengthen the structural strength of the base pad 40.

Figure 4:
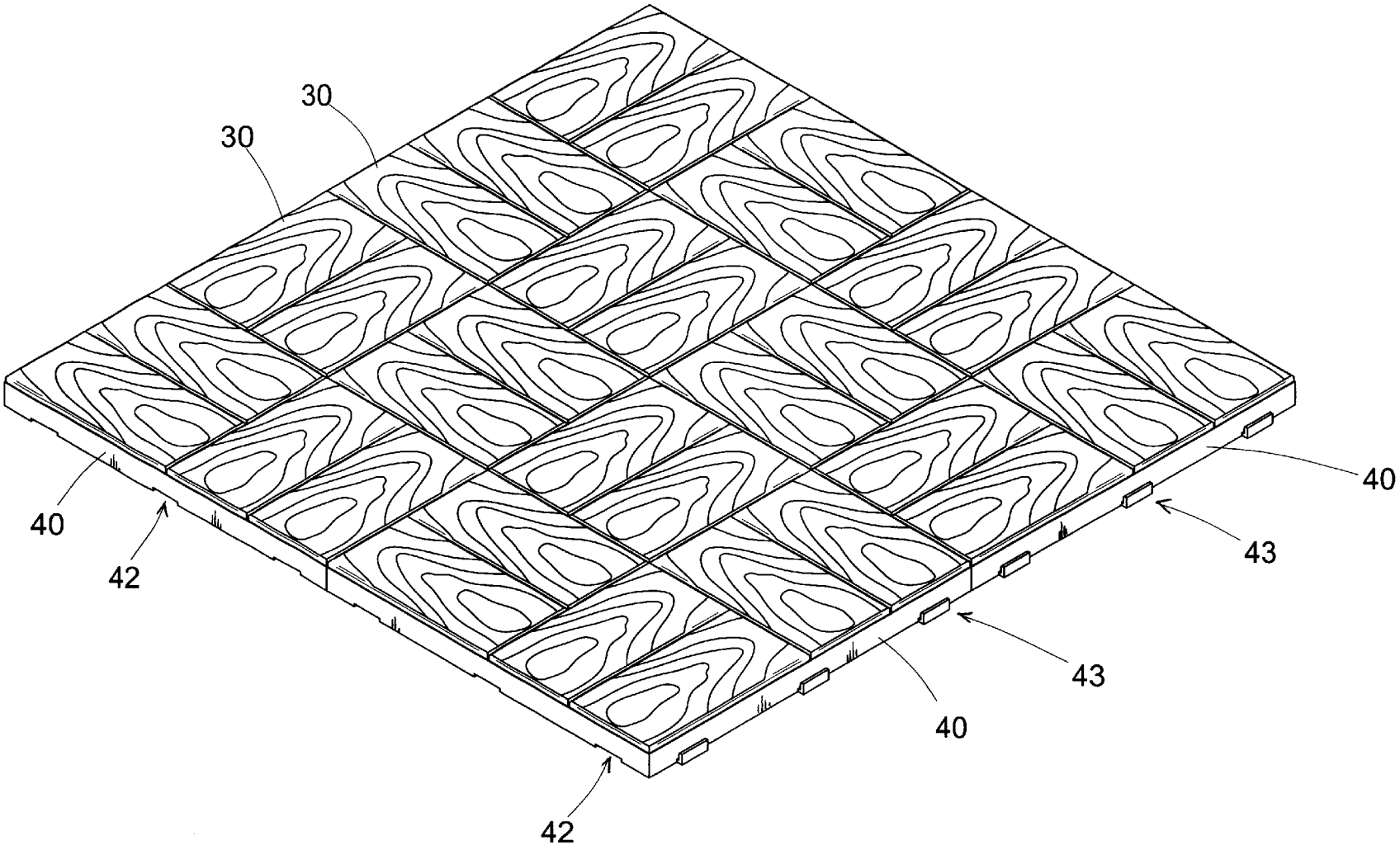
FIG. 4 is a schematic perspective view of the combination floor pad having composite base boards in accordance with the preferred embodiment of the present invention.

The base pad 40 has four sides, wherein two adjacent sides of the base pad 40 are formed with a plurality of recessed locking portions 42 as shown in FIG. 1, and the other two adjacent sides of the base pad 40 are formed with a plurality of inverted L-shaped hook-shaped snapping portions 43. Thus, when a plurality of base pads 40 are combined with each other as shown in FIG. 4, each of the snapping portions 43 of one of the base pads 40 is snapped into and locked in the respective locking portion 42 of another adjacent base pad 40, so that the multiple base pads 40 can be serially and successively combined in a snapping manner.

The base pad 40 has a periphery formed with four flexible side ribs 10 as shown in FIG. 1 so as to seal and encompass the periphery of the base pad 40. Each of the four side ribs 10 has a height smaller than the thickness of the base board 30 as shown in FIG. 2. Each of the four side ribs 10 has an inner side formed with a plurality of arcuate protruding portions 11 (as best shown in FIG. 2) that can be inserted into the arcuate groove 31 of the base board 30 when the base board 30 is inserted into the base pad 40. Each of the four side ribs 10 has a top formed with an arcuate top edge 12.

The base pad 40 has a surface integrally formed with a plurality of flexible positioning ribs 20 which are arranged longitudinally and transversely in a staggered manner. The positioning ribs 20 are enclosed by the four side ribs 10. The height of each of the positioning ribs 20 is the same as that of each of the side ribs 10. Each of the positioning ribs 20 has two sides each formed with a plurality of arcuate protruding portions 21 (as shown in FIGS. 1 and 2) that can be inserted into the arcuate groove 31 of the base board 30 when the base board 30 is inserted into the base pad 40. Each of the positioning ribs 20 has a top formed with an arcuate top edge 22. The arcuate top edge 22 of each of the positioning ribs 20 is formed with at least one water drain hole 23 (as shown in FIG. 2) extended through each of the positioning ribs 20 and the base pad 40. The positioning ribs 20 are connected with each other, and are connected with the four side ribs 10 as shown in FIG. 1, thereby forming multiple receiving spaces "A" in the base pad 40 for insertion and placement of the base boards 30.

Thus, each of the base boards 30 can be respectively inserted into and locked in the respective receiving space "A" of the base pad 40 formed by the positioning ribs 20 and the four side ribs 10.

In assembly, each of the base boards 30 is inserted into the respective receiving space "A" of the base pad 40 in an inclined manner, with one side of each of the base boards 30 being rested on the respective positioning rib 20, so that the protruding portion 21 of each of the positioning ribs 20 can be inserted into the arcuate groove 31 of one side of the respective base board 30. Then, the user can apply a press force on the other side of each of the base boards 30 to move toward the respective side rib 10, so that the protruding portion 11 of each of the four side ribs 10 can be snapped into the arcuate groove 31 of the other side of the respective base board 30 by the flexible feature of the side ribs 10.

Thus, when the base board 30 is inserted into the base pad 40, the arcuate protruding portion 11 of each of the four side ribs 10 can be snapped into the arcuate groove 31 of the base board 30 by the flexible feature of the side ribs 10, and the arcuate protruding portion 21 of each of the positioning ribs 20 can also be snapped into the arcuate groove 31 of the base board 30 by the flexible feature of the positioning ribs 20, so that each of the base boards 30 can be securely locked in the base pad 40 rigidly and stably, thereby preventing the base boards 30 from being detached or loosened from the base pad 40. In addition, each of the base boards 30 can be closely secured by the side ribs 10 and the positioning ribs 20, so that dirt or dust will not be deposited between the base boards 30, thereby facilitating the user cleaning the base boards 30.

Figure 3:
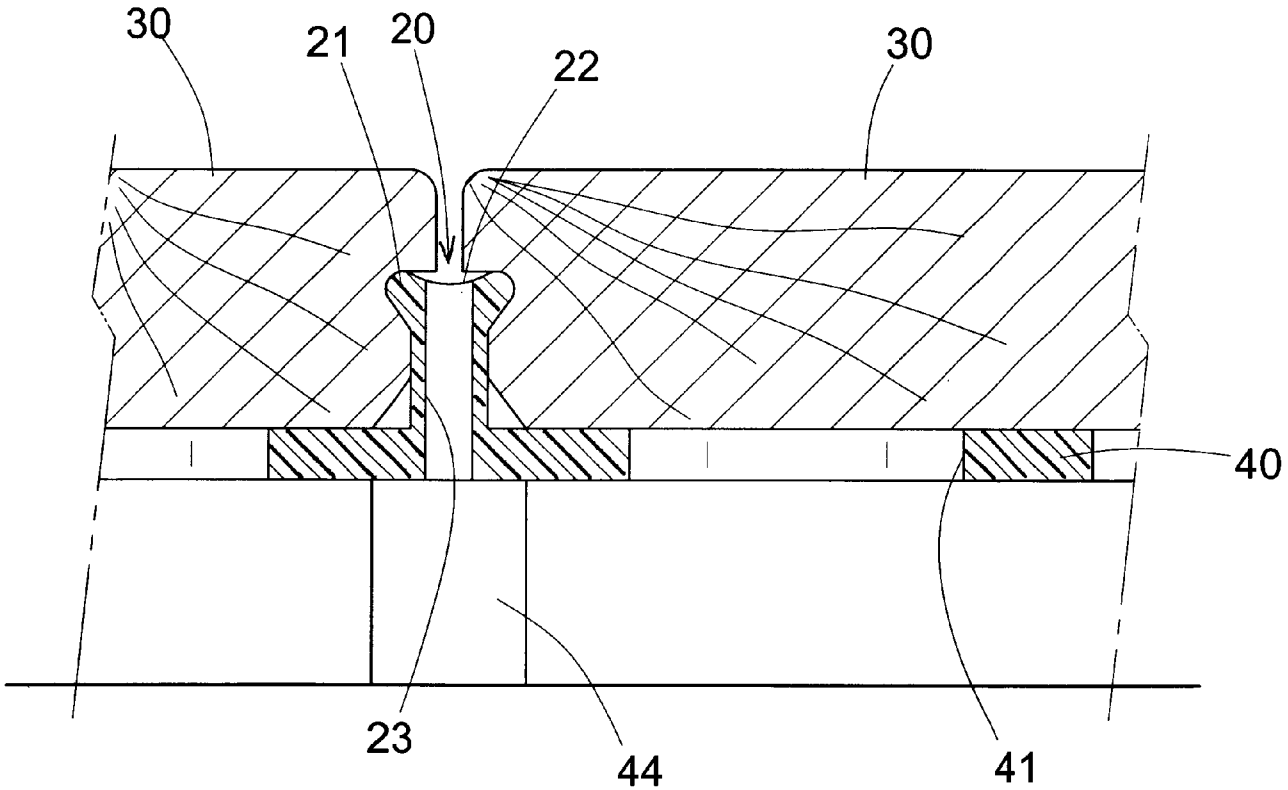
FIG. 3 is a partially cut-away plan cross-sectional assembly view of the combination floor pad having composite base boards in accordance with another embodiment of the present invention.

Referring to FIG. 3, the arcuate protruding portion 21 of each of the positioning ribs 20 is formed on the corner position between arcuate top edge 22 and the top of each side of the positioning rib 20, thereby enhancing the versatility of the combination floor pad.

Referring to FIGS. 1 and 4, in accordance with the preferred embodiment of the present invention, each of the base pads 40 has four sides, wherein two adjacent sides of the base pad 40 are formed with a plurality of recessed locking portions 42, and the other two adjacent sides of the base pad 40 are formed with a plurality of inverted L-shaped hook-shaped snapping portions 43.

Thus, when a plurality of base pads 40 are combined with each other as shown in FIG. 4, each of the snapping portions 43 of one of the base pads 40 is snapped into and locked in the respective locking portion 42 of another adjacent base pad 40, so that the multiple base pads 40 can be serially and successively combined in a snapping manner, and the multiple base pads 40 can be connected with each other rigidly and stably. In addition, the multiple base boards 30 are arranged longitudinally and transversely in a staggered manner as shown in FIG. 4, thereby enhancing the aesthetic quality of the combination floor pad.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A combination floor pad having composite base boards, comprising at least one base pad, and a plurality of base boards fixed on the base pad, wherein:

each of the base boards has four sides each formed with an arcuate groove;

the base pad has four sides, wherein two adjacent sides of the base pad are formed with a plurality of recessed locking portions, and the other two adjacent sides of the base pad are formed with a plurality of snapping portions;

the base pad has a periphery formed with four flexible side ribs so as to seal and encompass the periphery of the base pad;

the base pad has a surface formed with a plurality of flexible positioning ribs which are arranged longitudinally and transversely in a staggered manner, the positioning ribs are connected with each other and are connected with the four side ribs, thereby forming multiple receiving spaces in the base pad for insertion of the base boards;

each of the four side ribs has an inner side formed with a plurality of arcuate protruding portions that can be inserted into the respective arcuate groove of the base board when the base board is inserted into the respective receiving space of the base pad; and each of the positioning ribs has two sides each formed with an arcuate protruding portion that can be inserted into the respective arcuate groove of the base board when the base board is inserted into the receiving space of the base pad.

2. The combination floor pad having composite base boards in accordance with claim 1, wherein each of the snapping portions of the base pad is inverted L-shaped and can be locked in the respective recessed locking portion of another base pad.

3. The combination floor pad having composite base boards in accordance with claim 1, wherein each of the side ribs has a height smaller than a thickness of the base board, and each of the positioning ribs has a height the same as that of each of the side ribs.

4. The combination floor pad having composite base boards in accordance with claim 1, wherein the positioning ribs are enclosed by the four side ribs.

5. The combination floor pad having composite base boards in accordance with claim 1, wherein each of the side ribs has a top formed with an arcuate top edge, and each of the positioning ribs has a top formed with an arcuate top edge.

6. The combination floor pad having composite base boards in accordance with claim 5, wherein the arcuate top edge of each of the positioning ribs is formed with at least one water drain hole extended through each of the positioning ribs and the base pad.

7. The combination floor pad having composite base boards in accordance with claim 1, wherein the arcuate protruding portion of each of the positioning ribs is formed on a corner position between the arcuate top edge and a top of each side of the positioning rib.

8. The combination floor pad having composite base boards in accordance with claim 1, wherein the base pad has a bottom provided with a plurality of reinforcing posts.

9. The combination floor pad having composite base boards in accordance with claim 1, wherein the base pad is formed with a plurality of through holes.

* * * * *